United States Patent [19]

Tezuka

[11] 3,956,040

[45] May 11, 1976

[54] EXPLOSIVE SLURRY COMPOSITION CONTAINING SODIUM MONTMORILLONITE

[75] Inventor: Hiroshi Tezuka, Tokyo, Japan

[73] Assignee: Gelan Kabushiki Kaisha, Tokyo, Japan

[22] Filed: July 16, 1974

[21] Appl. No.: 488,992

[30] Foreign Application Priority Data

July 24, 1973 Japan ..... 48-82699
July 24, 1973 Japan ..... 48-82700

[52] U.S. Cl. ..... 149/41; 149/46; 149/47; 149/61; 149/62; 252/8.5 A

[51] Int. Cl.[2] ..... C06B 33/14; C06B 31/28; C06B 31/12; C09K 7/00

[58] Field of Search ..... 149/19.1, 20, 60, 61, 149/118, 41, 38, 46, 47, 62; 252/8.5 R, 8.5 A, 8.5 B; 260/70 R

[56] References Cited

UNITED STATES PATENTS

| | | | |
|---|---|---|---|
| 2,836,556 | 5/1958 | Thompson | 252/8.5 A |
| 2,988,438 | 6/1961 | Allovio | 149/20 |
| 3,112,233 | 11/1963 | Friedman | 252/8.5 R |
| 3,220,946 | 11/1965 | Turner | 252/8.5 A |
| 3,361,601 | 1/1968 | Chrisp | 149/19.91 |
| 3,369,945 | 2/1968 | Craig | 149/60 |
| 3,524,777 | 8/1970 | Wakazono | 149/60 |
| 3,681,156 | 8/1972 | Dick | 149/60 |
| 3,687,846 | 8/1972 | Lang | 252/8.5 A |
| 3,695,948 | 10/1972 | Clark | 149/20 |

OTHER PUBLICATIONS

Bradley; Journal American Chemical Society, Vol. 67, June 1945, pp. 975–981.

Hendricks, Journal of Physical Chemistry, Vol. 45, (1941), pp. 65–81.

Kirk–Othmer; Encyclopedia of Chemical Technology, 2nd Ed., Vol. 3, pp. 352–360.

*Primary Examiner*—Leland A. Sebastian
*Assistant Examiner*—Donald P. Walsh
*Attorney, Agent, or Firm*—Kemon, Palmer & Estabrook

[57] ABSTRACT

An explosive slurry composition having excellent suspension stability, good thixotropic characteristics, high detonation power and good temperature characteristics comprises as ingredients a water-swollen gel of a complex composed of sodium montmorillonite and a water-soluble organic compound having a polar group, and an oxygen supplier such as ammonium nitrate and/or a sensitizer such as aluminum powder and/or a fuel such as saccharide, fuel oil and the like. This explosive slurry composition is used for blasting hard rocks and the like in situ connected with a booster or cap.

19 Claims, No Drawings

EXPLOSIVE SLURRY COMPOSITION CONTAINING SODIUM MONTMORILLONITE

This invention relates to an explosive slurry composition comprising as an indispensable ingredient a water-swollen gel of a complex composed of montmorillonite and a water-soluble organic compound, especially an organic compound having a polar group such as $-NH_2$, -OH and $-SO_3H$ (hereinafter referred to as "polar compound").

By the term "slurry explosive" is generally meant an explosive which contains water and has fluidity and which is fed into a blasting situ by means of a pump and is exploded in siitu connected with a booster or cap for blasting hard rocks and the like.

Conventional slurry explosives are generally formed by incorporating and suspending an oxygen supplier, a sensitizer, a thickening agent and the like into water. As the oxygen supplier there are employed ammonium nitrate, sodium nitrate and the like, and as the sensitizer there are employed an organic sensitizer such as self-explosive T.N.T. and a metallic sensitizer such as aluminum powder and the like. Guhr gum or the like is incorporated as a thickening agent in conventional slurry explosives.

However, these conventional slurry explosives involve various defects that should be overcome. For example, the following defects and shortcomings are inevitably involved in conventional slurry explosives.

1. In conventional slurry explosives, sedimentation of the oxygen supplier, sensitizer, fuel or the like is caused to occur in the slurry with the lapse of time after preparation, and hence, reduction of the detonation power cannot be avoided.

In general, a slurry explosive may conprise 15 to 40% by weight of water and 40 to 70% by weight of ammonium nitrate, sodium nitrate or other oxygen supplier. When the oxygen supplier is contained at such a high concentration, with the lapse of storage time or if the ambient temperature is lowered below the saturated temperature of the oxygen supplier, the finely divided powers or particles of the oxygen supplier gradually cohere to form coarse crystals, which come to precipitate in the slurry.

Once such sedimentation occurs, pumping of the slurry explosive becomes difficult and the dispersion state of explosive ingredients becomes heterogeneous, resulting in reduction of the detonation power or in misfiring of slurry explosive.

Also the sensitizer such as aluminum powder is gradually sedimented with the lapse of time and this sedimentation has had influences on the exploding property. 2. Conventional slurry explosives are insufficient with respect to the thixotropic characteristics.

In general, it is desired that slurry explosives have so called "thixotropic" characteristics, namely they have such properties that on filling in a blasting hole the explosive is so lowly viscous and so fluid that pumping can be accomplished smoothly and after filling in a blasting hole the viscosity is recovered to an appropriate level.

In conventional slurry explosives, however, in order to improve the thixotropic characteristics it is necessary to add especially a thickening agent such as guhr gum. Moreover, in order to heighten viscosity of slurry after charging, it has been proposed to incorporate a cross-linking agent such as borax or potassium dicromate into the explosive before charging or to mix such a cross-linking agent together with the explosive by means of a separate feed pump.

These means, however, involve problems as to selection of the thickening agent or cross-linking agent, adjustment of the amount used of the thickening agent or cross-linking agent, and other controls to be made depending on the ambient temperature or the like. Therefore, none of these proposals give satisfactory results. 3. Bowden et al in "Initiation and Growth of Explosion In Solids and Liquids," Cambirdge University Press (1952) confirmed that microbubbles present in situ dispersed in the explosive generally give good results as regards the detonation power.

In conventional slurry explosives, however, this requirement is not satisfied and therefore, a method comprising adding such a chemical as sodium lauryl sulfate or sodium hydrogenborate or a method comprising adding glass microballoons for inseting air microbubbles has been proposed as means for overcoming this defect.

However, these methods are troublesome and high cost is necessary in order to practise them. Therefore, it cannot be said that these methods will always give satisfactory results.

It is therefore a primary object of this invention to provide a novel slurry explosive in which the above-mentioned fatal defects involved in conventional slurry explosives can be overcome and to which excellent and desirable properties are imparted.

More detailedly, the primary object of this invention is to provide a slurry explosive in which the above-mentioned undesired phenomenon of coarsening of crystals of ammonium nitrate or the like is not caused to occur even with the lapse of time or even if the ambient temperature changes in a broad range and which can retain a completely thixotropic state even without use of any particular thickening agent or cross-linking agent.

Another object of this invention is to provide an explosive slurry composition which inherently possesses a great number of microbubbles in such a dispersed state as will give good results to the detonation power.

I have conducted research on sodium montmorillonite (hereinafter referred to merely as "montmorillonite") for a long time with a view to developing effective uses of montmorillonite, and found that a macromolecule of a complex of montmorillonite and a water-soluble organic compound, especially a water-soluble organic compound having polar group such as $-NH_2$, -OH and $-SO_3H$, is very suitable as a base of a slurry explosive capable of attaining the foregoing objects. Based on this finding, I have now completed this invention.

Montmorillonite is a substance containing inherently oxides of Si, Al, Mg, Ca, Na, K and the like, and its crystals are very fine (for example, a particle size of about 0.1 $\mu$). Further, montmorillonite can form complex with a variety of water-soluble organic compounds, which are inserted between crystal lattice layers of montmorillonite in such complex. Further, the complex can form swollen-gel when water is incorporated in an amount 8 to 15 times the amount of montmorillonite.

For preparing the complex of this invention, the following water-soluble organic compounds can be used.

A. Urea and urea derivatives such, for example, as urea, guanidine nitrate, guanidine carbonate and water-soluble urea-formaldehyde resins.

B. Aliphatic and aromatic amines such, for example, as ethylamine, diethylamine and p-phenylene diamine.

C. Acid amides such, for example, as formamide.

D. Amino acids and proteins such, for example, as glycine, alanine (its methyl ester), valine glutamic acid, albumin, lactoalbumin casein and water-soluble gelatin.

E. Pyridines such, for example, as pyridine, piperidine, piperazine and pyridazine.

F. Cellulose derivatives such, for example, as carboxymethyl cellulose and carboxyethyl cellulose.

G. Aliphatic and aromatic polyhydric alcohols such, for example, as ethylene glycol, glycerin and polyvinyl alcohol.

H. Lignosulfonic acid salts such, for example, as sodium lignosulfonate and ammonium lignosulfonate.

I. Methyl nitramine monohydrate, dimethyl nitramine monohydrate, nitromethane and nitroethane.

As is disclosed in literature references, for instance, Bradley; J. Am. Chem. Soc., 67, pages 975 (1945) and Sterling; J. Phys. Chem., 45, pages 65–81 (1941), montmorillonite can readily form complex with organic compounds such as mentioned above.

As result of my experiments, it has been confirmed that many polar compounds can intrude in Van der Waals spaces in clearances between crystal lattice layers of montmorillonite to form complex.

When attapulgite (palygorskite) is used instead of montmorillonite, similar complex can be formed with these polar compounds.

As the oxygen supplier to be incorporated into a water-swollen gel of a complex of montmorillonite and such polar compound, there can be mentioned, for example, ammonium nitrate, sodium nitrate, ammonium perchlorate, etc. In view of the cost and exploding property, use of ammonium nitrate is most preferred. When the oxygen balance, solubility and other factors are taken into consideration, it is preferred to substitute a part (up to 50% by weight) of ammonium nitrate by sodium nitrate.

One of most characteristic features of the explosive slurry composition of the invention is that it retains a very good stability even with the lapse of time.

As pointed above, in conventional slurry explosives fine powders or particles of the oxygen supplier such as ammonium nitrate gradually cohere to form coarse crystals with the lapse of time or if the ambient temperature changes, and these crystals sediment in the slurry system to cause heterogeneous distribution of explosive ingredients.

In contrast, in the water-swollen gel of a complex of montmorillonite and a polar compound according to this invention, ammonium nitrate and other ingredients do not cause such undesired phenomenon.

The reason has not completely been elucidated, but it is believed that the water-swollen gel of a complex of montmorillonite and a polar compound is present in the system in the form of a macromolecule and this macromolecule has an activity to prevent coarsening of crystals and causes such a strong linkage with ammonium nitrate or the like as will prevent cohesion and crystallization of ammonium nitrate or the like, with the result that a stable suspension state can be maintained for a long time.

It is surprising that also with respect to a powder of a metal to be used as a sensitizer, such as aluminum powder, the initial stable state can be retained for a long time in a water-swollen gel of the complex of this invention.

It is believed that this feature may probably be attained by the molecular absorption of the surface of montmorillonite, though the detailed reason has not completely been elucidated.

In respect to conventional slurry explosives, various methods have been proposed as means for maintaining a good suspension stability of ingredients. There can be mentioned, for example, a method comprising incorporating carboxymethyl cellulose, a protein or the like into the slurry and a method comprising adding an acid salt of a higher alkyl amine or a salt of lauryl sulfate.

As a result of my experiments, however, it has been confirmed that none of these proposals give such excellent results as attainable according to this invention. It has also been found that a water-swollen gel of the complex of this invention gives much better results than those attained by a water-swollen gel composed merely of montmorillonite.

In the case of a water-swollen gel of the complex of this invention, it also is possible to keep a petroleum such as fuel oil in the stably dispersed state in the slurry explosive. In case detonation of a slurry explosive is effected only with a petroleum such as fuel oil, the handling safety is generally much higher than when a self-explosive sensitizer is employed, and further, the operation cost is much lower. Therefore, in the art it is generally desired that detonation of a slurry explosive is effected only with a petroleum.

However, as a result of my experiments it has been confirmed that it is impossible to retain a sufficiently stable dispersion of such fuel in conventional slurry explosives for a long time, and cohesion and phase-separation of the fuel gradually occur, resulting in reduction of the detonation power of the explosive.

In the explosive slurry composition of this invention composed of a water-swollen gel of the above-mentioned complex, the foregoing problems involved in conventional techniques are solved and it is possible to improve greatly the suspension stability of a petroleum in the explosive slurry. In this invention, the dispersibility of a petroleum can be further heightened by incorporating a lower acid amide or water-soluble alkyl amine in an amount of 0.3 to 0.7% by weight based on the total composition.

Excellent thixotropic characteristics of the explosive slurry composition of this invention will now be described. Most of colloidal systems, especially concentrated emulsions and suspensions, have a so-called thixotropic property, namely a property that when they are made fluid by application of stress, softening occurs and the viscosity is lowered but if the fluid state is caused to disappear, the viscosity is returned to the original high level.

Although a water-swollen gel composed merely of montmorillonite has such thixotropic property, a water-swollen gel of a sodium montmorillonite complex of this invention is especially excellent in thixotropic characteristics required of a slurry explosive, and it can readily be pumped into a blasting hole and the required viscosity can promptly be recovered throughout the entire composition after charging. Accordingly, there is attained an advantage that when the explosive of this invention is charged in, for instance, a downwardly inclined hole, the charged explosive does not flow down.

In the explosive slurry composition of this invention, microbubbles making a desired contribution to the blasting effect are inherently contained.

By Bowden et al supra who proposed Hot Spot Theory, it has already been confirmed that microbubbles of air or gas present in an explosive are compressed in an adiabatic state at the initial stage of detonation, whereby the blasting effect is further enhanced.

In the montmorillonite complex of this invention, since the shape of montmorillonite crystals is flat and irregular and the particle size differs greatly within a range of 100 $\mu$ to 30 $\mu\mu$, a space is inherently present in each crystal. Furthermore, since fine particles of montmorillonite make a contribution to enhancement of the shock interaction caused by shock waves of detonation. Thus, it is believed that by virtue of features the state desired and suitable for detonation can be attained in the explosive slurry composition of this invention.

In the case of the explosive slurry composition of this invention, any of particular means for formation of air bubbles such as indispensable in conventional slurry explosives, need not be adopted and the intended object can naturally be attained.

Embodiments of the explosive slurry composition will not be described.

The explosive slurry composition of this invention is formed by adding 50 to 70 parts by weight of ammonium nitrate or a mixture of ammonium nitrate and sodium nitrate as an oxygen supplier to 23 to 32 parts by weight of a water-swollen gel of a complex of montmorillonite and a polar compound, adding 3 to 12 parts by weight of at least one member selected from powdery metals such as aluminum powder, saccharides such as sucrose, urea and petroleum such as fuel oil as a sensitizer and/or a fuel and further adding small amounts of a viscosity adjusting agent, a dispersing agent and/or a buffer agent according to need.

According to this invention, a water-swollen gel of a complex composed of montmorillonite and a polar compound is prepared by pulverizing a bentonite ore, suspending the resulting particles in water, passing the resulting suspension-sol through a filter of about 300 mesh to remove the majority of the silt, allowing the filtered suspension-sol to stand still to sediment a silt of a fine size, decanting the resulting suspension-sol free of this silt, heating and concentrating the suspension-sol to form a water-swollen gel in which the weight ratio of montmorillonite: water is within a range of from 10 : 90 to 15 : 85, adding 1 to 5 parts by weight of a polar compound to 22 to 28 parts by weight of the so formed gel, and agitating sufficiently the resulting mixture to form a desired water-swollen gel of a complex of the polar compound and montmorillonite. In practising the above preparation process, it is possible to add an aqueous solution containing a desired amount of the polar compound to the suspension-sol before the heating step to effect concentration.

Then, 50 to 70 parts by weight of ammonium nitrate or an oxygen supplier composed of more than 50% by weight of ammonium nitrate and less than 50% by weight of sodium nitrate is incorporated into 23 to 33 parts by weight of the so formed water-swollen gel of the complex of montmorillonite and the polar compound.

Furthermore, a sensitizer or a fuel is incorporated, into the resulting admixture. Aluminum powder is most suitable as the sensitizer, and it is preferred that aluminum powder has a flaky form of a size of 50 to 325 mesh, which has a broad size-distribution range including very fine particles. In the explosive slurry composition of this invention, the amount incorporated of aluminum powder does not exceed 6% by weight based on the total explosive. In case aluminum powder is incorporated just before use of the explosive, deterioration or degradation of the explosive can be avoided. When aluminum powder is incorporated and then the explosive is stored for a certain period, the pH of the explosive is adjusted to 3.5 to 5.5 by addition of a buffer solution. When petroleum is incorporated, use of fuel oil having a calorific value of 10,000 to 11,000 Kcal/Kg is preferred. In addition, liquid paraffins of a low volatility composed of alkyl naphthenes can be used as the fuel. Moreover, carbonaceous materials such as sucrose and fructose can be used as the fuel. Urea is also a preferred fuel.

In addition to the foregoing ingredients, ions of humic acid, lignosulfonic acid and tannic acid are optionally incorporated in amounts not exceeding 2% by weight based on the composition as a peptizer.

In case a fuel oil is employed, in order to maintain a good dispersion state in the slurry, it is very effective to incorporate lower acid amides such as acetamide and acrylamide or water-soluble alkyl amines.

This invention will now be illustrated more detailedly by reference to Examples.

EXAMPLE 1

A bentonite ore was pulverized and suspended in water, and the majority of the silt was removed by passing the resulting suspension-sol through a filter of about 300 mesh. The filtered suspension-sol was then allowed to stand still for 20 hours to sediment a silt of a finer size. The so formed silt-free suspension-sol was subjected to decantation and concentrated under heating to obtain a water-swollen gel in which the montmorillonite : water weight ratio was 12 : 88.

Then, 3 parts by weight of urea was incorporated into 28 parts by weight of the so formed gel and the mixture was sufficiently agitated to obtain 31 parts by weight of a water-swollen gel of a complex of montmorillonite and urea.

Then, 62 parts by weight of ammonium nitrate as an oxygen supplier, 5 parts by weight of aluminum powder as a sensitizer and 2 parts by weight of urea as a fuel were added to the water-swollen gel of the complex, and a minute amount of a buffer agent was further added in order to maintain the pH of 3.5 to 5.5. Thus was obtained about 100 parts by weight of a typical instance of the explosive slurry composition of this invention.

A part of the so obtained composition was charged in a cartridge having a diameter of 50 mm and a length of 400 mm, and it was subjected to the explosion test at an ambient temperature of 20°C. or 5°C. with use of a booster (10 g of dynamite) and a cap (No. 6). In each case, the explosive completely shot and the detonation velocity was 4,200 m/sec at an ambient temperature of 20°C. and 4,100 m/sec at an ambient temperature of 5°C.

The same composition was allowed to stand still at about 20°C. for 480 hours and after this storage the explosion test was conducted under the same conditions as above. The detonation velocity was 4,100 m/sec at an ambient temperature of 20°C. and 4,000 m/sec at an ambient temperature of 5°C. Thus, it was found that no substantial degradation of the detonation power was brought about by storage.

In the case of a comparative sample of a conventional slurry explosive composed of 18 parts by weight of water, 70 parts by weight of ammonium nitrate, 10 parts by weight of aluminum, 2 parts by weight of a thickening agent and a minute amount of a buffer agent, the detonation velocity was 4,800 m/sec at 20°C. just after preparation but it was lowered to 4,400 m/sec at 5°C. After 480 hours' storage, the sample did not shoot at the explosion test conducted at 20°C. Thus, it was confirmed that the detonation property of the sample was greatly degraded by storage.

In the case of another comparative sample composed of 30 parts by weight of a water-swollen gel composed merely of montmorillonite, 62 parts by weight of ammonium nitrate, 8 parts by weight of an aluminum powder and a minute amount of a buffer agent, the detonation velocity was 3,300 m/sec at 20°C. and 3,200 m/sec at 0°C., and after 480 hours' storage, the detonation speed was lowered to 2,900 m/sec at 20°C. Thus, it was confirmed that in the case of this comparative sample the detonation velocity was lower than in the case of the explosive slurry composition of this invention and the degree of degradation of the detonation power was rather greater than in the case of the explosive slurry composition of this invention.

EXAMPLES 2 to 5

Ammonium nitrate alone or its mixture with a minor amount of sodium nitrate was incorporated as an oxygen supplier into a water-swollen gel of a complex of montmorillonite and urea, a water-soluble urea-formaldehyde resin or a mixture thereof as a polar compound. Aluminum powder as a sensitizer and urea or sucrose as a fuel were further incorporated. The so formed explosive slurry composition was subjected to the explosion test at an ambient temperature of 20°C. The composition of each explosive and the explosion test results are shown in Table 1.

Table 1

| | Example | | | |
|---|---|---|---|---|
| | 2 | 3 | 4 | 5 |
| A. Composition (parts by weight) | | | | |
| (1) Water-swollen gel of complex of montmorillonite and polar compound: | | | | |
| (a) gel of montmorillonite and water (12:88) | 25 | 25 | 25 | 25 |
| (b) urea | | 1.2 | 1.5 | 1.5 |
| (c) water-soluble urea-formaldehyde resin | 2.5 | | | 3 |
| (2) oxygen supplier: | | | | |
| ammonium nitrate | 60 | 60 | 60 | 62 |
| sodium nitrate | 4 | 4 | 4 | 3 |
| (3) sensitizer and fuel: | | | | |
| aluminum powder | 4 | 4 | 2 | 1 |
| urea | | 1.3 | | 4.5 |
| sucrose | 4.5 | 4.5 | 7.5 | |
| (4) buffer agent | minute amount | minute amount | minute amount | minute amount |
| B. Detonation Velocity (m/sec) (results of the test conducted with use of cartridge of 50 mm diameter and 400 mm length, booster (10 g of dynamite) and cap No. 6) | | | | |
| just after preparation | 4,000 | 4,200 | 3,800 | 4,100 |
| after 480 hours' storage | 3,800 | 4,000 | 3,700 | 4,100 |

From the results shown in the above Table, it is seen that when a water-swollen gel of the montmorillonite complex of this invention is employed, the properties of the explosive are hardly degraded with the lapse of time.

EXAMPLES 6 to 10

As the polar compound for formation of the complex with montmorillonite, at least two members selected from ethylene glycol, glycerol, pyridine, protein (albumin) and sodium lignosulfonate were used in addition to, or instead of, a urea type compound. Ammonium nitrate as an oxygen supplier and urea and sucrose as a fuel were employed but no sensitizer was incorporated.

The composition of each explosive sample and the results of the detonation test are shown in Table 2.

Table 2

| | Example | | | | |
|---|---|---|---|---|---|
| | 6 | 7 | 8 | 9 | 10 |
| A. Composition of Explosive (parts by weight) | | | | | |
| (1) water-swollen gel of complex of montmorillonite and polar compound: | | | | | |
| (a) swollen gel of montmorillonite and water (12:88) | 23 | 23 | 25 | 25 | 25 |
| (b) ethylene glycol | 1.5 | 0.5 | | | |
| (c) pyridine | | 2 | 1.5 | | |
| (d) glycerol | 0.5 | | | 2 | |
| (e) protein (albumin) | | | | | 1 |
| (f) urea | 0.5 | | 0.5 | 0.5 | 0.5 |
| (g) sodium lignosulfonate | 0.5 | | | 0.5 | 1.5 |
| (2) ammonium nitrate | 65 | 65 | 65 | 65 | 65 |
| (3) fuel: | | | | | |
| urea | 5 | 5.5 | 5 | 5 | 5 |
| sucrose | 4 | 4 | 3 | 2 | 2 |
| B. Detonation Test Results (test was conducted with use of cartridge 20 mm diameter and 300 mm length and cap No. 6) | | | | | |
| at 5°C | shot | failed | failed | shot | shot |
| at 25°C | shot | shot | shot | shot | shot |
| C. Detonation Velocity (m/sec as measured at 25°C.) (results of test conducted with use of cartridge of 50 mm diameter and 400 mm length and cap No. 6) | 3,500 | 3,400 | 3,400 | 3,800 | 4,100 |

As is apparent from the test results shown in the above Table, the explosive slurry composition of this invention is characterized in that it can be completely detonated even when a sensitizer such as aluminum powder is not particularly incorporated.

It was found that an explosive having a composition of Example 10 is especially excellent in the thixotropic characteristics.

EXAMPLES 11 to 15

As the polar compound for formation of a complex with montmorillonite, carboxymethyl cellulose, polyvinyl alcohol or formamide was employed in addition to the urea type compound. The composition of each explosive and the results of the explosion test are shown in Table 3.

Table 3

| | Example | | | | |
|---|---|---|---|---|---|
| | 11 | 12 | 13 | 14 | 15 |
| A. Composition (parts by weight) | | | | | |
| (1) water-swollen gel of complex of montmorillonite and polar compound: | | | | | |
| (a) swollen gel of montmorillonite and water (12:88) | 25 | 25 | 25 | 23 | 23 |
| (b) carboxy-methyl cellulose | 1.5 | | 1.5 | | 1.0 |
| (c) polyvinyl alcohol | | 1.3 | | 1.5 | |
| (d) urea | 1.5 | 1.7 | 1.3 | 1.0 | 0.5 |
| (e) sodium lignosulfonate | | | 0.5 | 0.5 | 1.0 |
| (f) formamide | | | 1.2 | | 0.5 |
| (2) oxygen supplier | | | | | |
| ammonium nitrate | 63 | 63 | 63 | 62 | 62 |
| sodium nitrate | | | | 3 | 3 |
| (3) sensitizer and fuel: | | | | | |
| aluminum powder | 2 | | 2 | | |
| sucrose | | 3 | 2.5 | 3 | 4 |
| Urea | 7 | 6 | 3 | 6 | 5 |
| buffer agent | minute amount | | minute amount | | |
| B. Results of Detonation Test (conducted with use of cartridge of 50 mm diameter and 400 mm length) | | | | | |
| at 0°C. | shot | shot | shot | failed | shot |
| at 30°C. | shot | shot | shot | shot | shot |
| detonation velocity (m/sec as measured at 0°C.) | 3,700 | 3,500 | 3,900 | 3,800 | 3,800 |

From the results shown in the above Table, it is seen that the detonation property of the explosive slurry composition of this invention is not degraded at a lower temperature, and it is possible to obtain a desired detonation velocity optionally by changing the composition of the montmorillonite complex.

EXAMPLES 16 to 20

Explosives free of a metallic sensitizer, compositions of which are shown in Table 4, were prepared by employing fuel oil as a fuel. These explosives were subjected to the detonation test. The composition of each explosive and results of the detonation test are shown in Table 4.

Table 4

| | Example | | | | |
|---|---|---|---|---|---|
| | 16 | 17 | 18 | 19 | 20 |
| A. Composition (parts by weight) | | | | | |
| (1) water-swollen gel of complex of montmorillonite and polar compound: | | | | | |
| (a) swollen gel of montmorillonite and water (13:87) | 23.5 | 23.5 | 23.5 | 23.5 | 23.5 |
| (b) urea | 3 | 2 | 1 | 3 | 3 |
| (c) carboxy-methyl cellulose | | 1 | 2 | | |
| (2) oxygen supplier: | | | | | |
| ammonium nitrate | 68 | 63 | 63 | 68 | 68 |
| sodium nitrate | | 5 | 5 | | |
| (3) fuel: | | | | | |
| fuel oil | 5 | 5 | 5 | 5 | 5 |
| (4) dispersing agent: | | | | | |
| acetamide | 0.5 | | 0.5 | | |
| ethylamine | | 0.5 | | 0.5 | |
| B. Results of Detonation Test (conducted at 20°C. with use of cartridge of 50 mm diameter and 400 mm length and cap No. 6) | | | | | |
| detonation velocity (m/sec): | | | | | |
| just after preparation | 4,000 | 3,700 | 3,700 | 4,100 | 3,900 |
| after 480 hours' storage | 3,600 | 3,300 | 3,400 | 4,000 | 3,700 |

As is seen from the results shown in the above Table, in the explosive slurry composition of this invention fuel oil can be used as the fuel, and the detonation property of the explosive slurry composition of this invention is hardly degraded even if it is stored for a long time.

EXAMPLES 21 to 24

As the polar compound for formation of a complex with montmorillonite, nitromethane or methyl nitramine mono hydride was employed in addition to the ethylene glycol type compound. The composition of each explosive and the results of the explosion test are shown in Table 5.

Table 5

| | Example | | | |
|---|---|---|---|---|
| | 21 | 22 | 23 | 24 |
| A. Composition of Explosive (parts by weight) | | | | |
| (1) Water-swollen gel of complex of montmorillonite and polar compound: | | | | |
| (a) swollen gel of montmorillonite and water (15:85) | 20 | 20 | 18 | 18 |
| (b) nitromethane | | | 7 | 7 |
| (c) methyl nitramine monohydrate | 8 | 8 | | |
| (d) ethylene glycol | 4 | 4 | 2 | 2 |
| (2) Oxygen supplier: | | | | |
| ammonium nitrate | 50 | 50 | 50 | 50 |
| sodium nitrate | 8 | 6 | 6 | 6 |
| (3) Sensitizer and fuel | | | | |
| aluminum powder | 2 | | | 2 |
| urea | 6 | 8 | 10 | 8 |
| ethylene glycol | 2 | 4 | 7 | 7 |
| B. Results of Detonation Test (conducted cartridge of 30 mm diameter and 400 mm length) | | | | |
| at −10°C | shot | shot | shot | shot |
| at 0°C | shot | shot | shot | shot |
| detonation velocity (m/sec as measured at −10°C) and Cap No. 6 | 5,300 | 5,300 | 4,800 | 5,000 |

What is claimed is:

1. A explosive composition which comprises an aqueous slurry of:

a. at least one inorganic oxidizing salt; and b. a complex of sodium montmorillonite and a water-soluble organic compound containing at least one $-NH_2$, -OH or $-SO_3H$ group, said complex being in the form of a water-swollen gel in which the sodium montmorillonite: water weight ratio is between about 10:90 and 15:85.

2. An explosive slurry composition set forth in claim 1 wherein the water-soluble organic compound containing a polar group is at least one member selected from the group consisting of urea, guanidine nitrate, guanidine carbonate, water-soluble urea-formaldehyde resins, ethylamine, diethylamine, p-phenylene diamine, formamide, glycine, alanine methyl ester, valine, glutamic acid, albumin, lactoalbumin, casein, water-soluble gelatin, pyridine, piperidine, piperazine, pyridazine, carboxymethyl cellulose, carboxyethyl cellulose, ethylene glycol, glycerin, polyvinyl alcohol, sodium lignosulfonate, ammonium lignosulfonate, nitromethane, nitroethane, methyl nitramine and dimethyl nitramine.

3. An explosive slurry composition set forth in claim 1 wherein ammonium nitrate or a mixture of more than 50% by weight of ammonium nitrate and less than 50% by weight of sodium nitrate is incorporated as the oxygen supplier in an amount of 50 to 70 parts by weight per 23 to 33 parts by weight of the water-swollen gel of the complex of montmorillonite and the water-soluble organic compound containing a polar group and at least one member selected from aluminum powder, urea, sucrose and petroleum such as fuel oil is incorporated as the sensitizer and/or fuel in an amount 5 to 12 parts by weight per 23 to 33 parts by weight of the water-swollen gel of the complex of montmorillonite and the water-soluble organic compound containing a polar group.

4. An explosive slurry composition set forth in claim 3 wherein 60 to 67 parts by weight of ammonium nitrate is incorporated into 23 to 33 parts by weight of a water-swollen gel of a sodium montmorillonite-urea complex prepared by adding 1 to 5 parts by weight of urea to 22 to 28 parts by weight of a swollen gel of sodium montmorillonite and water in which the sodium montmorillonite : water weight ratio is within a range of from 10 : 90 to 15 : 85, and 2 to 5 parts by weight of aluminum powder, 1 to 5 parts by weight of urea and 0 to 9 parts by weight of sucrose are further incorporated into the resulting admixture.

5. An explosive slurry composition set forth in claim 3 wherein 60 to 67 parts by weight of ammonium nitrate is incorporated into 23 to 33 parts by weight of a water-swollen gel of a complex of sodium montmorillonite, urea and sodium lignosulfonate prepared by adding 0.5 to 1.5 parts by weight of a protein, 0.5 to 2 parts by weight of urea and 0 to 1.5 parts by weight of sodium lignosulfonate to 22 to 28 parts by weight of a swollen gel of sodium montmorillonite and water in which the sodium montmorillonite : water weight ratio is within a range of from 10 : 90 to 15 : 85, and 4 to 7 parts by weight of urea and 1 to 5 parts by weight of sucrose are further incorporated in the resulting admixture.

6. An explosive slurry composition set forth in claim 3 wherein 60 to 67 parts of ammonium nitrate is incorporated into 23 to 33 parts by weight of a water-swollen gel of a complex of sodium montmorillonite and, carboxymethyl cellulose, urea, formamide and/or sodium lignosulfonate prepared by adding 0.5 to 2 parts by weight of carboxymethyl cellulose, 0.3 to 1.5 parts by weight of urea, 0.2 to 1.5 parts by weight of formamaide and 0 to 1 part by weight of sodium lignosulfonate to 22 to 28 parts by weight of a swollen gel of sodium montmorillonite and water in which the sodium montmorillonite : water weight ratio is within a range of from 10 : 90 to 15 : 85, and 1 to 3 parts by weight of aluminum powder, 2 to 4 parts by weight of sucrose and 2 to 5 parts by weight of urea are further incorporated into the resulting admixture.

7. The explosive composition of claim 1 wherein said inorganic oxidizing salt consists of at least 50% by weight of ammonium nitrate.

8. The explosive composition of claim 7 wherein said salt consists of a mixture of at least 50% by weight ammonium nitrate with sodium nitrate.

9. The explosive composition of claim 1 wherein said water soluble organic compound is selected from the group consisting of urea, urea derivatives, aliphatic amines, aromatic amines, acid amides, amino acids, proteins, pyridines, cellulose derivatives, aliphatic polyhydric alcohols, aromatic polyhydric alcohols, lignosulfonic acid salts, methyl nitramine monohydrate, nitromethane, nitroethane and mixtures thereof.

10. The explosive composition of claim 1 which contains a sensitizer.

11. The explosive composition of claim 10 wherein said sensitizer is aluminum metal.

12. The explosive composition of claim 1 which contains a fuel.

13. The explosive composition of claim 12 wherein said fuel is petroleum oil, alkyl naphthenes, sucrose, fructose, urea or mixtures thereof.

14. The explosive composition of claim 1 which contains aluminum metal as a sensitizer and petroleum oil as a fuel.

15. The explosive composition of claim 1 which contains a peptizer.

16. The explosive composition of claim 15 wherein said peptizer is humic acid, lignosulforic acid or tannic acid.

17. The explosive composition of claim 1 which consists essentially of ammonium nitrate, a water-swollen complex of sodium montmorillonite with urea and sucrose.

18. A process for preparing a water-swollen gel of a complex of sodium montmorillonite and a water-soluble organic compound containing at least one $-NH_2$, -OH or $-SO_3H$ group which comprises pulverizing a bentonite ore, suspending the resulting particles in water, removing silt from the resulting suspension-sol, concentrating the suspension -sol to form a gel in which the sodium montmorillonite: water weight ratio is within a range of from about 10:90 to 15:85, incorporating about 1 to 5 parts by weight of said organic compound into about 22 to 28 parts by weight of said gel and then agitating the resulting mixture.

19. The process of claim 18 wherein said organic compound is selected from the group consisting of urea, guanidine nitrate, guanidine carbonate, water-soluble urea-formaldehyde resins, ethylamine, diethylamine, p-phenylene diamine, formamide, glycine, alanine methyl ester, valine, glutamic acid, albumin, lactoalbumin, casein, water-soluble gelatin, pyridine, piperidine, piperazine pyridazine, carboxymethyl cellulose, carboxyethyl cellulose, ethylene glycol, glycerin, polyvinyl alcohol, sodium lignosulfonate, ammonium lignosulfonate, nitromethane, nitroethane, methyl nitramine and dimethyl nitramine.

* * * * *